US007457201B2

(12) United States Patent
Jaermann et al.

(10) Patent No.: US 7,457,201 B2
(45) Date of Patent: Nov. 25, 2008

(54) MECHANICAL GOLF COUNTER

(75) Inventors: Urs Jaermann, Zurich (CH); Pascal Stubi, Zurich (CH); Christian Chatelain, Tramelan/BE (CH)

(73) Assignee: Jaermann & Stubi AG, Zurich (CH)

( * ) Notice: Subject to any disclaimer, the term of this patent is extended or adjusted under 35 U.S.C. 154(b) by 0 days.

(21) Appl. No.: 11/609,649

(22) Filed: Dec. 12, 2006

(65) Prior Publication Data

US 2007/0147174 A1 Jun. 28, 2007

(30) Foreign Application Priority Data

Dec. 22, 2005 (CH) ..... 2041/05

(51) Int. Cl.
*G04B 47/00* (2006.01)
*A63B 69/36* (2006.01)

(52) U.S. Cl. ..... 368/10; 473/131; 473/213; 235/1 B; 235/60 C; 235/112

(58) Field of Classification Search ..... 368/10; 473/213, 131; 235/1 B, 60 C, 112, 121
See application file for complete search history.

(56) References Cited

U.S. PATENT DOCUMENTS

| | | | | |
|---|---|---|---|---|
| 1,714,070 | A | 5/1929 | Beskow | |
| 5,432,759 | A * | 7/1995 | Vaucher | 368/28 |
| 5,550,884 | A | 8/1996 | Berney | |
| 5,769,740 | A | 6/1998 | Colangelo | |
| 6,466,518 | B1 * | 10/2002 | Akahane et al. | 368/64 |
| 6,543,681 | B1 * | 4/2003 | Wiederrecht et al. | 235/60 C |
| 6,646,958 | B1 | 11/2003 | Geiger | |
| 7,057,976 | B2 * | 6/2006 | Berseth et al. | 368/10 |
| 2005/0259520 | A1 * | 11/2005 | Forsey et al. | 368/80 |

FOREIGN PATENT DOCUMENTS

| | | |
|---|---|---|
| CH | 663318GA3 | 12/1987 |
| DE | 3816713 A1 | 11/1989 |
| EP | 0987610 A1 | 3/2000 |
| EP | 1 099 459 A1 | 5/2001 |
| EP | 1099459 | 5/2001 |
| GB | 373 272 A | 5/1932 |

* cited by examiner

*Primary Examiner*—Vit W. Miska
*Assistant Examiner*—Sean Kayes
(74) *Attorney, Agent, or Firm*—Rankin, Hill & Clark LLP

(57) ABSTRACT

A golf counter is constructed in a completely mechanical manner and includes a first counting mechanism with a display (202) for counting a number of strokes per hole, a second counting mechanism with a display (203) of a total number of strokes, and a third counting mechanism with a display (204) of played holes, wherein a press button (212) for indexing the third counting mechanism to the next position automatically sets the first counting mechanism into a zero position. Thereby, the display of the second counting mechanism is a sum hand (203) which may be rotated about a central pivot of the golf counter. The sum hand (203) permits an analog representation of the state of the game, in contrast to the common two-or three digit displays with digit disks. The counting mechanism is preferably designed as an autonomous module, and is arranged in a watch between the dial and the clockwork.

5 Claims, 7 Drawing Sheets

MECHANICAL GOLF COUNTER

BACKGROUND OF THE INVENTION

1. Field of the Invention

The invention relates to the field of purely mechanical counting devices for registering the state of the game when playing golf, in particular to a mechanical golf counter.

2. Description of Related Art

U.S. Pat. No. 1,714,070 discloses a purely mechanical golf counter for the game of golf, with five concentric digit disks for the display of the stroke number at the current hole, the hole number and total stroke number.

U.S. Pat No. 5,769,740 describes a tool with a watch with two numbered rings which are attached around the watch and are rotatable independently of one another, for recording states of the game with the game of golf.

EP 0 987 610 A1 discloses a watch with a mechanism for the analog display of a number of strokes per hole, by way of a number of colored points on a rotatable display disk. On actuation of the stroke counter, the analog displays as well as a sum display with two or three positions or digit disks, are indexed to the next position. The mechanism is only partly disclosed. The analog display is set to zero on actuation of the hole counter. The beginning of the game time may be marked with a bezel.

U.S. Pat. No. 6,646,958 B1 describes further details of a watch which externally is designed in a similar manner, in particular a mechanical counter which may also count backwards for correcting wrong inputs. In order to continue to count at the next hole, an individual press button is activated several times in accordance with the stroke number stored in the analog display. The analog display is set back to zero in a stepped manner by way of this, and the sum display is incremented in a stepped manner. No hole counter is present.

EP 1 099 459 discloses a watch with an integrated, purely mechanical counting mechanism for registering the state of the game within a game of golf. A first analog display with a hand is advanced by way of a first push button for registering strokes per hole. A two-digit sum counter for the total number of strokes comprises two digit disks, and is simultaneously indexed to the next position with the actuation of the first push button. A second analog display with a hand for the display of the hole number is indexed to the next position on actuation of a second push button, and the first display is set back to zero. A crown must be rotated by hand for zeroing the sum counter. The first analog display is limited in movement to a single revolution, which corresponds to a given number of, for example, 12 strokes per hole. One may not count further if this number is exceeded. The total number of strokes is limited to 99 on account of the two-digit display with digit disks opposite one another. The watch may therefore only be used for players with certain minimum capabilities.

A watch with two independent counters is described in DE 197 25 078 A1. Each of the counting mechanisms may be actuated for counting up and down by way of two push buttons, so that the point numbers of two persons or teams may be recorded. Although a mechanical display of the counting mechanism that counts via number disks is mentioned, no solution for realizing this display is disclosed.

CH 663 318 G A3 describes a purely mechanical watch with four independent, in each case two-digit counting mechanisms, which may be set back via a common zeroing device.

DE 38 16 713 A1 likewise shows a watch with two counters specifically for recording the state of the game with a game of golf. On actuating a counting mechanism, a hand in a display field of a stroke counter as well as a sum counter with a three-digit number display is indexed to the next position. On actuating an advance press button, the hand in the display field is set back, and a two-digit hole counter is indexed to the next position. Although a mechanical realization of this function is mentioned, no solution is however disclosed for such a realization.

U.S. Pat. No. 5,550,884 shows an electronic watch with analog hands which are driven via stepper motors and comprise different counting and representation modes.

BRIEF SUMMARY OF THE INVENTION

It is therefore the object of the invention to provide a mechanical golf counter of the initially mentioned type which overcomes the mentioned disadvantages.

The golf counter is constructed in a purely mechanical manner and comprises a first counting mechanism with a display for counting a number of strokes per hole, a second counting mechanism with a display of a total number of strokes, and a third counting mechanism with a display of played holes, wherein a push button for indexing the third counter to the next position automatically sets the first counter back into a zero position. Thereby, the display of the second counter is a sum hand which may be rotated about a central pivot of the golf counter. The sum hand permits an analog representation of the state of the game, in contrast to the usual two or three-digit displays with digit disks.

The counting mechanism is preferably designed as an autonomous module. It may thus be arranged in a watch between the dial and the clockwork. Thereby, the pivots of the watch hands run through the hollow pivot for the sum hand.

In a preferred embodiment of the invention, a bezel is rotatably arranged around a dial of the golf counter. The bezel has markings, for setting a handicap with regard to the position of the sum hand. A direct optical and analog display of the state of the game whilst taking into account the handicap of the player is possible with this.

For example, the sum hand makes a complete revolution for 72 strokes. Fixed markings are accordingly arranged on the periphery of the dial with 1 to 72 for the first revolution, and further up to 144 for the second revolution. Thereby, only the numbers for the second revolution, between 72 and 144 may be incorporated, or only for an end region of the first revolution and a beginning region of the second revolution, e.g. up to 126, since only in this region does a comparison to the handicap really provide information. If a player has a normal stroke number of 90, then at the beginning, he sets a central marking or zero marking opposite to the number 90 on the dial, by way of rotating the bezel. Towards the end of the game, the relative position of the sum counter to this setting may be recognized immediately, in an analog manner and without any calculation. The complete result with regard to the usual handicap is evident in the same manner after the end of the game.

Preferably, the first counter, as a display, comprises a revolving hand, wherein the revolving hand may be rotated by more than one revolution on counting. The capacity of the first counter is therefore not limited to a number of strokes corresponding to a revolution, for example to twelve strokes. Preferably, the first counter undergoes a revolution for exactly ten strokes, so that after the first revolution, the display "4" represents the number "14".

In a first preferred embodiment of the invention, the revolving hand is rigidly connected to a cog, with which cog a toothing of a moving transmission element is engaged, wherein the transition element with its position represents the number of strokes per hole. The above-mentioned capacity of the first counting mechanism, thus the maximal number of strokes per hole, is thus given by the length of the toothing of the transmission element and is, for example, 18 or 24 or more strokes.

The transmission element preferably comprises a further toothing, which is coupled to a sum transmission mechanism which on zeroing the first counter, transmits its count into the second counting mechanism with the sum hand. Basically however, the sum transmission mechanism may also be coupled directly to the cog of the revolving hand of the first counting mechanism, and not to the transmission element. In both cases, on zeroing the first counter, the transmission element is moved into its zero position, wherein the other elements of the first counting mechanism co-move. During this movement, the second counting mechanism is coupled to the first counting mechanism, so that the number of steps through which the first counting mechanism moves on being set to zero, is transmitted into the second counting mechanism. The coupling of the counting mechanisms and the resetting of the first counting mechanism is effected by actuating the same press button. This press button preferably also effects an advance of the third counting mechanism or hole counter.

The third counting mechanism as a display, preferably has a retrograde display, which is to say a hand which, up to a maximum count of typically 18 holes, only sweeps through a sector of a circle, and further comprises a return mechanism.

In a second preferred embodiment of the invention, the sum of the strokes together with the strokes per hole is counted up. Thus, no sum transmission mechanism is present, but in particular a stroke counting rocker, which on activation of a respective press button, advances the first counting mechanism (strokes per hole) as well as the second counting mechanism (total number of strokes) in each case by one step.

On advancing the third counting mechanism (thus of the hole counter), the first counting mechanism is simultaneously zeroed in that the stroke counter zeroing lever is pressed against a heart-like eccentric of the first counting mechanism. Thereby, the second counting mechanism is not affected. Preferably, the stroke counter zeroing lever reaches from the region of the third counting mechanism around the sum wheel into the region of the first counting mechanism in a sickle-like manner.

On common zeroing of all three counting mechanisms, preferably by way of a zeroing lever, the heart of the sum wheel is rotated into the zero position, and a further zeroing lever is moved. The further zeroing lever in turn actuates the stroke counter zeroing lever and releases a block which permits the retrograde hand of the first counting mechanism to resile back into the zero position.

In further preferred embodiments of the invention, the golf counter has a common reset mechanism with a zeroing lever for zeroing all three counting mechanisms by actuating a single press button.

In a further preferred embodiment of the invention, the fulcrums of all three counting mechanism are arranged along a straight line, for example over one another on the perpendicular middle symmetry axis of a watch dial. This is particularly aesthetically pleasing, but necessitates a suitable mechanical construction, so that the mechanism finds space in a housing which is as flat as possible. Preferably, furthermore the press buttons for actuating (i.e. for advancing and for zeroing) the counting mechanisms are all arranged on the same side of this straight line. In order to achieve a flat constructional manner under these circumstances, with the first as well as with the second preferred embodiment of the invention, a connection lever reaches around the sum wheel from the region of the third counting mechanism into the region of the first counting mechanism. With the first embodiment, the connection lever is identical to the transmission element, with the second embodiment, the connection lever is identical to the stroke counter zeroing lever. The connection lever in both embodiments is actuated by way of the press button of the hole counter, which is arranged on the lower part of the mechanism, and acts on the first counting mechanism which is arranged in the upper part of the mechanism. In both embodiments, preferably a second or further zeroing lever serves for transmitting the movement from the zeroing lever to the connection lever. This second or further zeroing lever engages in the vicinity of the fulcrum of the connection lever, such that a relatively small movement of the second or the further zeroing lever is converted by the connection lever into a larger movement in the region of the first counting mechanism, in particular for zeroing the first counting mechanism.

BRIEF DESCRIPTION OF THE DRAWINGS

Hereinafter the subject-matter of the invention is described in more detail by way of preferred embodiments which are shown in the accompanying drawings. Basically, parts with the same function have been provided with the same reference numerals in the figures. In each case, in a schematic manner, there are shown in.

DETAILED DESCRIPTION OF THE INVENTION

Figure 1:
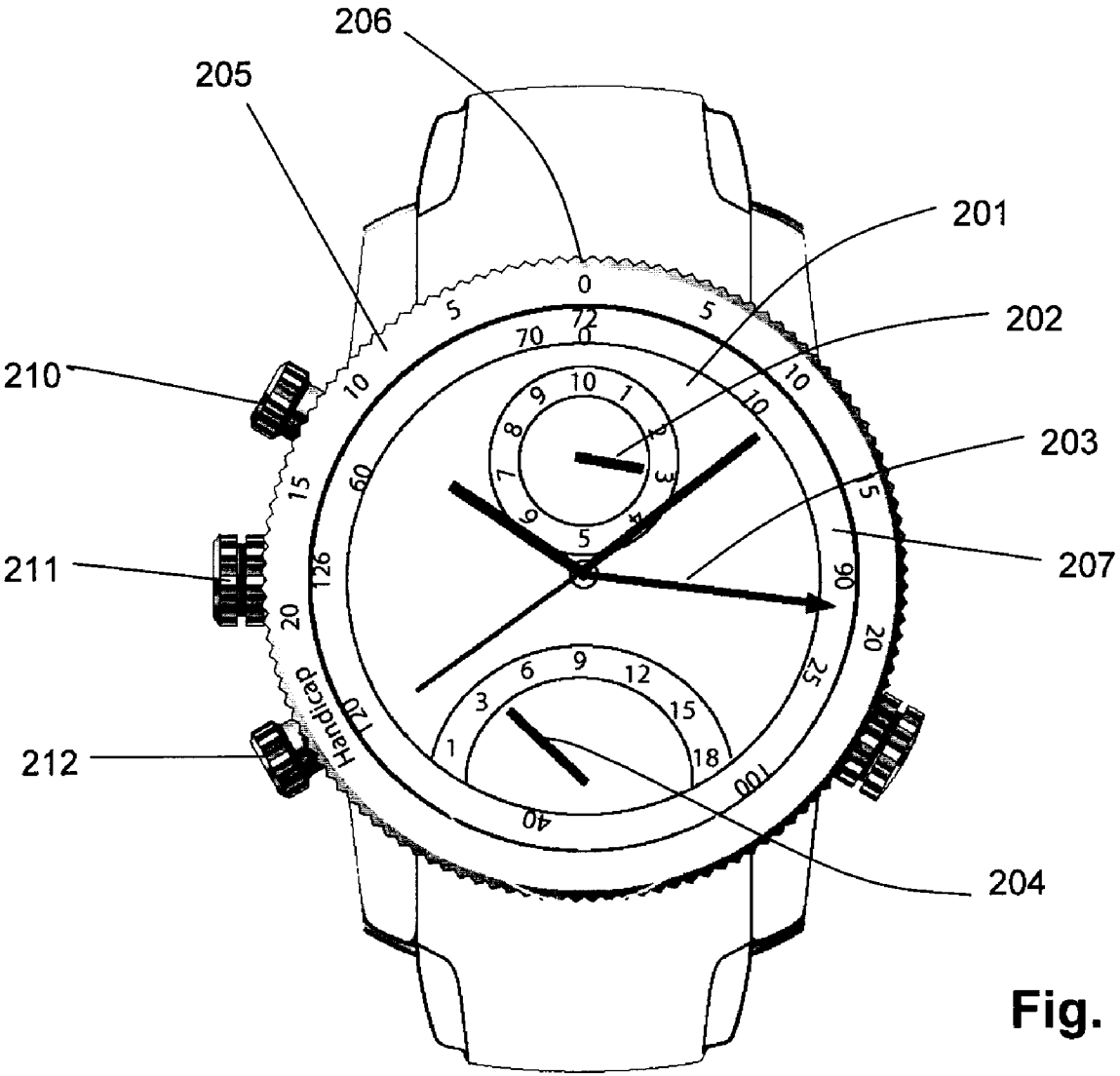
FIG. 1 a view of a watch with a golf counter, according to the invention.

FIG. 1 schematically shows a plan view of a wrist watch according to a preferred embodiment of the invention. Arranged on a dial 201 are a hand 202 for indicating the number of strokes per hole, a central sum hand 203 for the display of the total stroke number, and a hand 204 for the display of the played hole. A sum scale 207 is arranged at the edge of the dial 201 for reading off the position of the central sum hand 103. This, for example, has one dash per stroke, and numbers, which indicate the state of the game during the first or further revolutions. A variant with 72 strokes per revolution of the sum hand 203 is shown in the Figure. A rotatable bezel 205 is arranged around the dial 201. This comprises a particular bezel marking 206 for setting a handicap, indicated in the Figure at "0". For this, the bezel 205 is rotated until the bezel marking 206 is opposite the stroke number on the sum scale 207, which corresponds to the handicap. Preferably, further markings with dashes and/or numbers which at the end of the game indicate differences from the handicap by a certain stroke number on account of the final position of the sum hand 203, are arranged on the bezel 205 on both sides of the bezel marking 206. The hour hand, the minute hand and the second hand as usual, are arranged centrally. Three press buttons 210,211,212 serve for the actuation of the counting mechanism.

Figure 3:
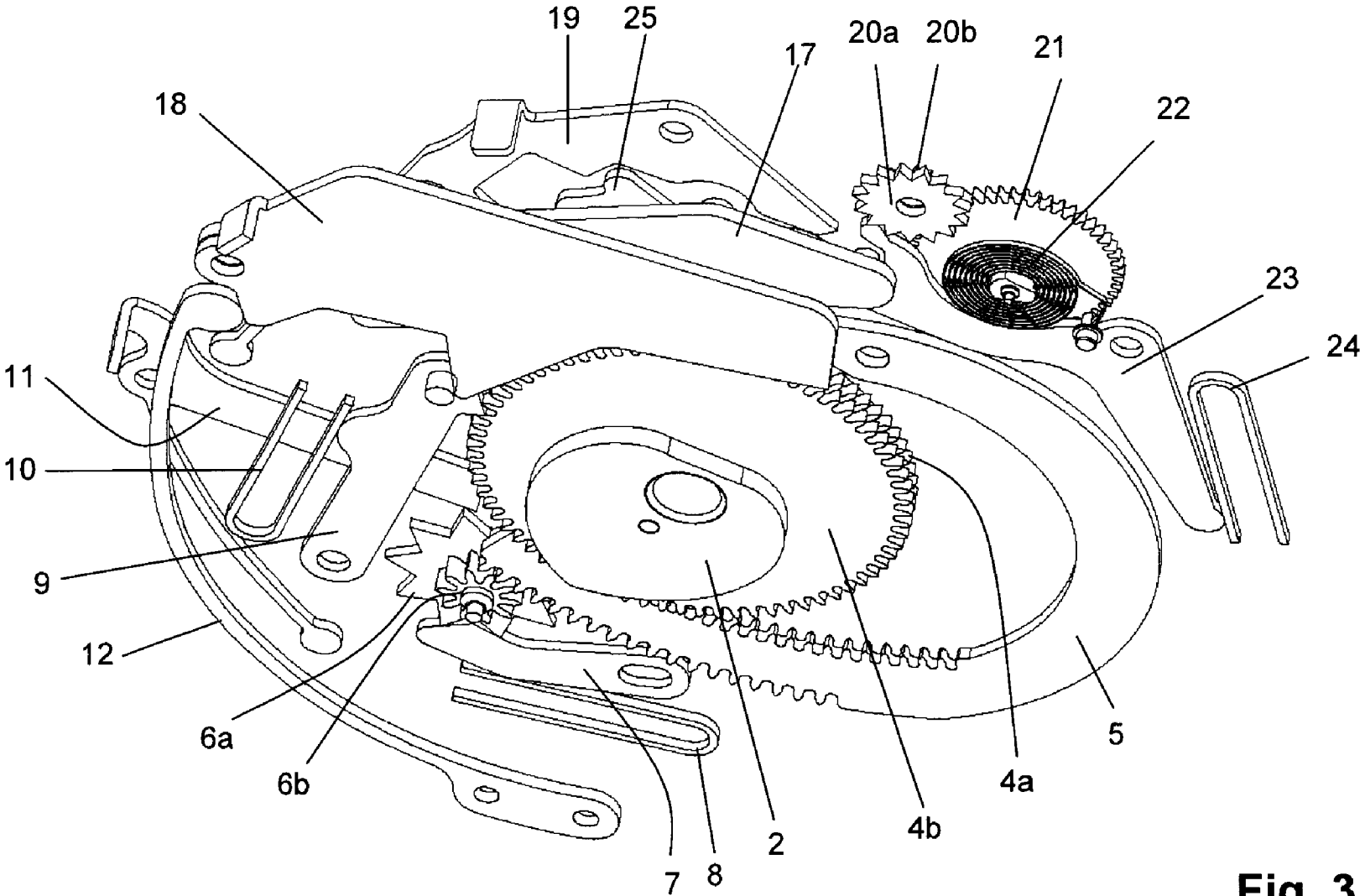
FIGS. 3 and 4 perspective views of the essential parts of this first embodiment.
Figure 4:
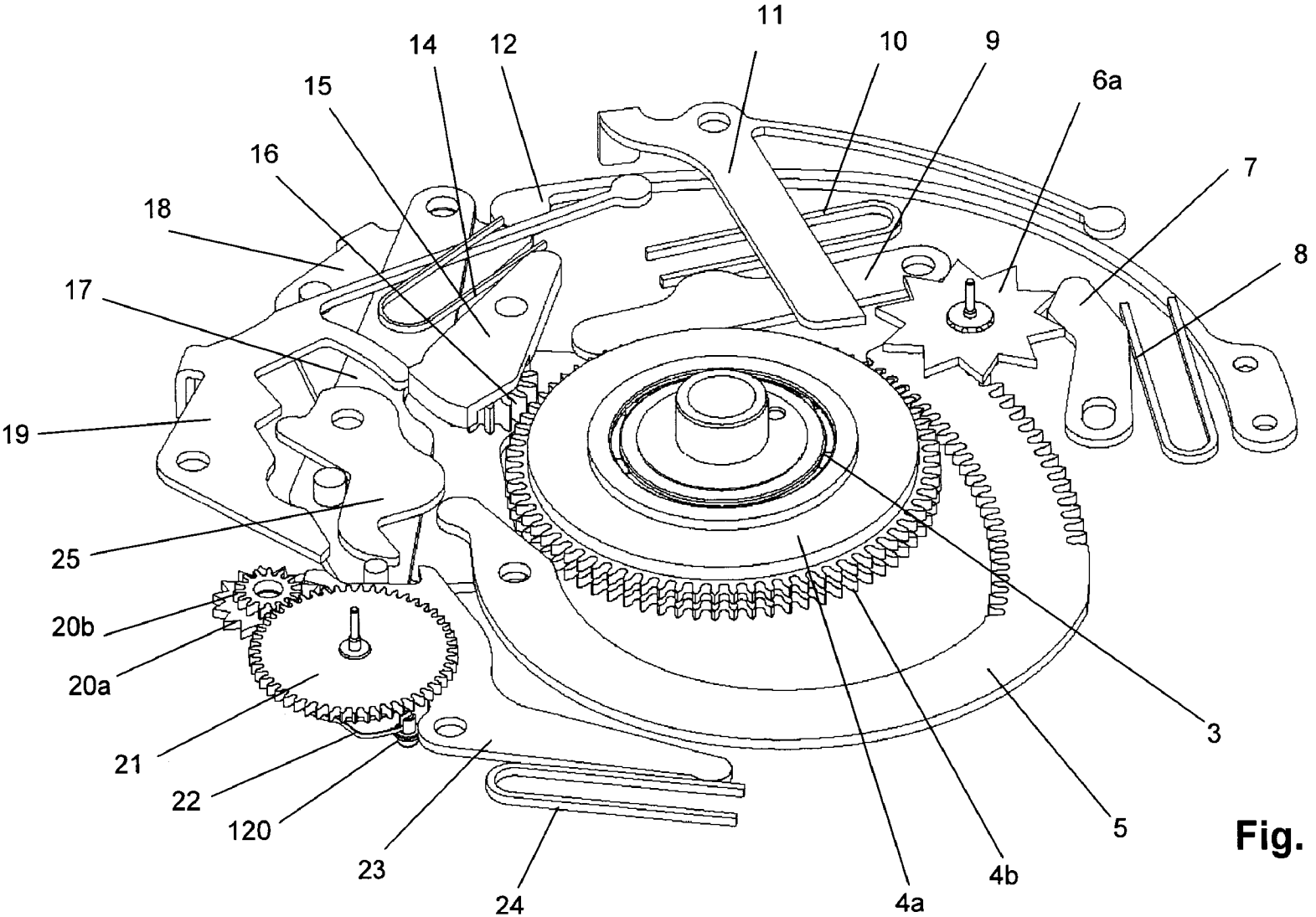

The manner of functioning of the counting mechanism is hereinafter explained together with the structure with reference to the FIGS. 2 to 4. The counter mechanism is preferably arranged in a housing and may be a module that is combined with a clockwork.

The stroke counter is actuated by way of pressing —via a first press button 210 —onto the press arm 129 of a stroke counting rocker 11. The stroke counting rocker 11 rotates about a pivot 102. Thereby, a lever arm 127 of the stroke counter rocker 11 rotates a star 6*a* further by one position, in FIG. 2 in the clockwise direction. The star 6*a* is subjected to the effect of a detent 7 which is rotatable about a pivot 103 and presses against a detent spring 8. Fastened to the star 6*a* is the hand 202 for the display of the strokes per hole. When the stroke counting rocker 11 is let go of, this is moved against a spring end 105 back into the initial position by way of a spring region.

A cog 6*b* which is fastened on the star 6*a* and is concentric, is engaged with a first toothing 122 on the outer side of a rack 5. The rack 5 is rotatable about a pivot 117, and the first toothing 122 as well as a second toothing 121 of the rack 5 lying opposite the first toothing are concentric to this pivot 117. The second toothing 121 is engaged with a sum transmission wheel 4*a*. On rotation of the rack 5, the sum transmission wheel 4*a* is accordingly co-rotated. The toothings 121, 122 of the rack, of the cog 6*b*, and of the sum transmission wheel 4*a* are such that they move further in each case by a tooth on actuation of the stroke counting rocker 11. On counting the strokes, the sum transmission wheel 4*a* is not meshed with further elements. The sum transmission wheel 4*a* is mounted in a ball bearing 3.

On counting the strokes, only the star 6*a* with the cog 6*b*, the rack 5 and the sum transmission wheel 4*a* are adjusted, and subsequently fixed by the detent 7. It is thus possible to move back these elements in a stepped manner, without influencing the remaining mechanics. With this, one may correct incorrect actuations of the first press button 210. For this, a (non-shown) further press button arrangement may be realized, with which the star 6*a* may be rotated in the other direction. For example, a further rocker with a press button is arranged in an essentially mirror-symmetrical manner to the stroke counting rocker 11 for this.

A sum wheel 4*b* with the same toothing is arranged parallel and concentrically to the sum transmission wheel 4*a*. A locking pawl 9 with a spring 10 and rotatable about a pivot 104, is in engagement with the teeth of the sum wheel 4*b*, and on the one hand acts as a detent, and on the other hand such that the sum wheel 4*b* may only move in the clockwise direction. The sum wheel 4*b* is rigidly connected to a heart-shaped eccentric 2 and to the central hand 203 for the display of the total stroke number, so that these may be rotated together about the central pivot 125 of the arrangement.

The hole counter is actuated by way of pressing —via a second press button 212 —onto a press button arm 131 of a hole counting rocker 19. The hole counting rocker 19 rotates about a pivot 110. A first lug 123 of the hole counting rocker 19 rotates a transmission lever 15 with a transmission cog 16 about a pivot 108 against the force of a spring 14 against the sum transmission wheel 4*a* and the sum wheel 4*b*. The transmission cog 16 is designed with such a height, that it is in engagement with the sum transmission wheel 4*a* as well as with the sum wheel 4*b*, and thus, these are coupled to one another via the transmission cog 16.

With a continued movement of the hole counting rocker 19, then a second lug 133 of the hole counting rocker 19 presses against a lug 129 of a reset lever 25 of the stroke counter. The reset lever 25 rotates about a pivot 111 and presses with its restoring lug 113 against a lever arm 116 of the rack 5. The rack 5 is rotated back in the clockwise direction by way of this. Thereby, the rack 5 on the one hand rotates the cog 6*b* with the hand 202 for the display of the strokes per hole back into the zero position, and on the other hand the rack also rotates the sum transmission wheel 4*a* in the clockwise direction back into the zero position. Since the sum transmission wheel 4*a* is now coupled to the sum wheel 4*b* via the transmission cog 16, thereby, the sum wheel 4*b* is also rotated further by the number of strokes for the last hole.

Figure 2:
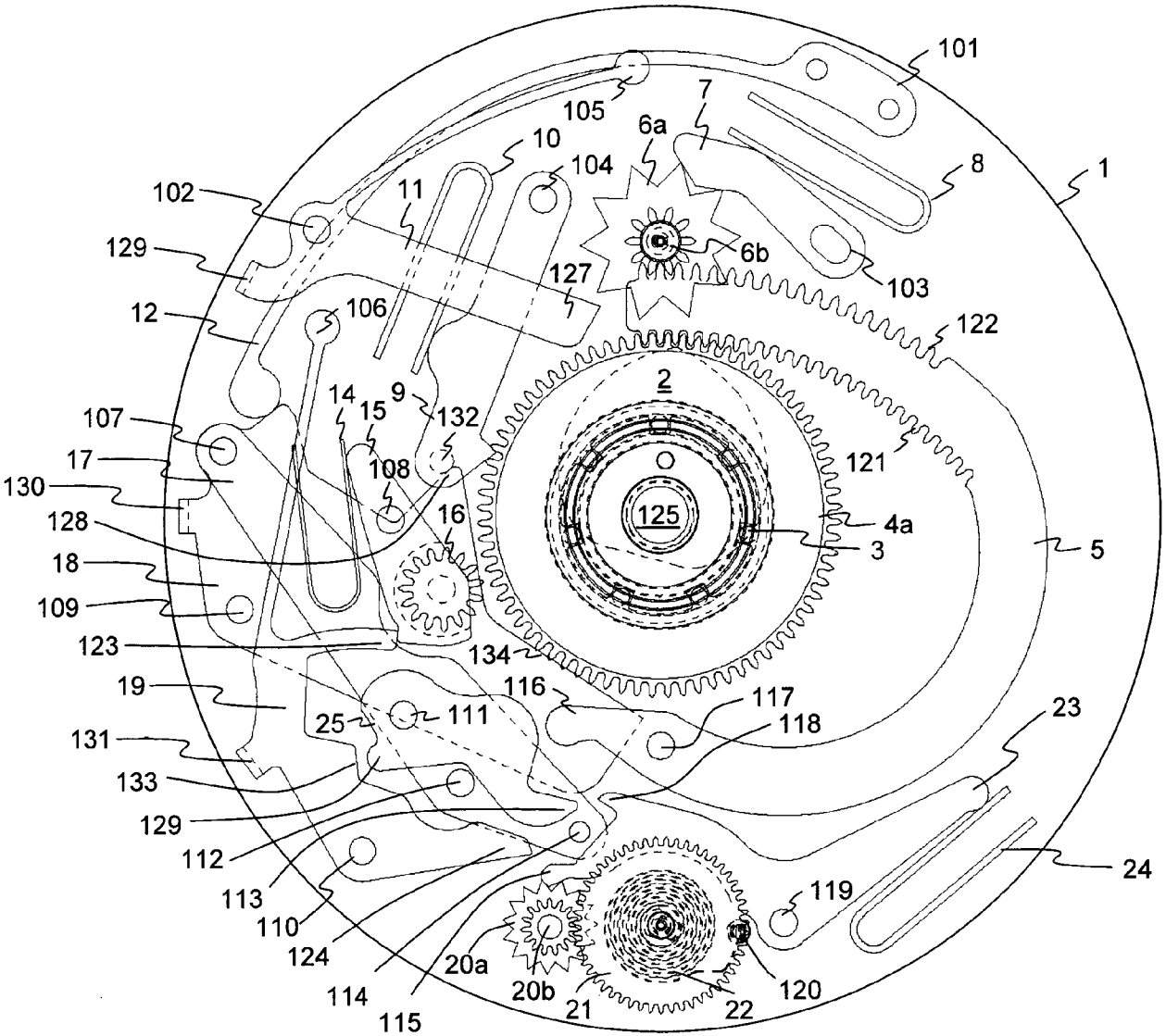
FIG. 2 the essential parts of a first preferred embodiment of the golf counter.

With the further forward movement of the hole counting rocker 19, a third lug 124 of the hole counting rocker 19 rotates a star 20*a* of the hole counter by one step further, in FIG. 2 in the clockwise direction. The star 20*a* is subjected to the effect of a lug 115 of a detent 23, as well as a detent spring 24. A cog 20*b* fastened on the star 20*a* is in engagement with a hole counting wheel 21 and rotates this further by one count position. The hand 204 for the display of the hole is fastened on the hole counting wheel 21. The hole counting wheel 21 is connected by a spring 22 to a fastening point 120 of the spring. This spring 22 is tensioned on counting up the hole number.

Thus after a completed actuation of the hole counting rocker 19, the hand 202 for the number of strokes per hole is again at zero, and the total number of strokes corresponds to the position of the sum wheel 4*b*, and thus to the position of the central hand 203. The hole counter has been moved further by one position. On letting go the hole counter rocker 19, this is moved back through a spring region against a spring end 106 back into the initial position.

For zeroing the entire device, a press button arm 103 of a first zeroing lever 18 is actuated via a third press button 211. This lever rotates about a pivot 107. A lug 128 on the first zeroing lever 18 thereupon via a pin 132, lifts the locking pawl 9 from the sum wheel 4*b*, and subsequently an edge 134 of the first zeroing lever 18 sets the heart-shaped eccentric 2 back into the zero position. With this, the sum wheel 4*b* and the central hand 203 also get back into the zero position.

The other counters are zeroed simultaneously with the above-described zeroing of the sum hand 203. After the first zeroing lever 18 has travelled a part of its path, a pin 109 of the first zeroing lever 18 catches a second zeroing lever 17. Both zeroing levers 17, 18 rotate about the same pivot 107. The second zeroing lever 17 in turn, by way of a pin 112, moves the already known reset lever 25 of the stroke counter, which sets the rack 5 and the stroke counter to zero as already described above.

The second zeroing lever 18 furthermore, via a pin 114, moves a lug 118 of the detent 23 of the hole counter against the force of the detent spring 24. At the lug 115, the star 29*a* of the hole counter is released by way of this, and the star 20*a* and the hole counting wheel 21 are rotated back by the spring 22 into the zero position.

On letting go of the press button of the first zeroing lever 18, this is rotated back into the initial position by way of a restoring spring 12 which is fastened to a fastening point 101.

The device may yet comprise further elements, for example a block for preventing an excessive movement of the rack 5, or locking means for preventing a simultaneous actuation of several press buttons.

Proceeding from the principle described here, and essentially equally structured mechanics, one may also realize other arrangements. For example, the hand 202 for the display of the strokes per hole may be arranged concentrically to the sum hand 203, and coupled to the cog 6*b* via a further cog or a toothed belt. Furthermore, the number of the counter positions per revolution with each of the counters may be varied without further ado. The third counter instead of the spring 22, may also comprise a heart or a section of a heart for zeroing by way of a corresponding section of one of the zeroing levers 17, 18, or a further lever connected thereto. The first counter for the number of strokes per hole may also have a resetting mechanism with a spring as with the hole counter, instead of the detent 7. For example, the rack 5 may be connected to an analog optical display, with which an increasing number of points or a colored bar appears in the dial on counting the strokes. These appear in a window shaped in the manner of a circular arc, wherein the middle point of the circular arc lies at the fulcrum 117 of the rack 5.

The manner of functioning of the counting mechanism in a second preferred embodiment of the invention is hereinafter explained together with the structure with reference to the FIGS. 5 to 7 or 8. The counting mechanism is preferably arranged in a housing 1 and may be, as a module, combined with a clockwork.

Figure 5:
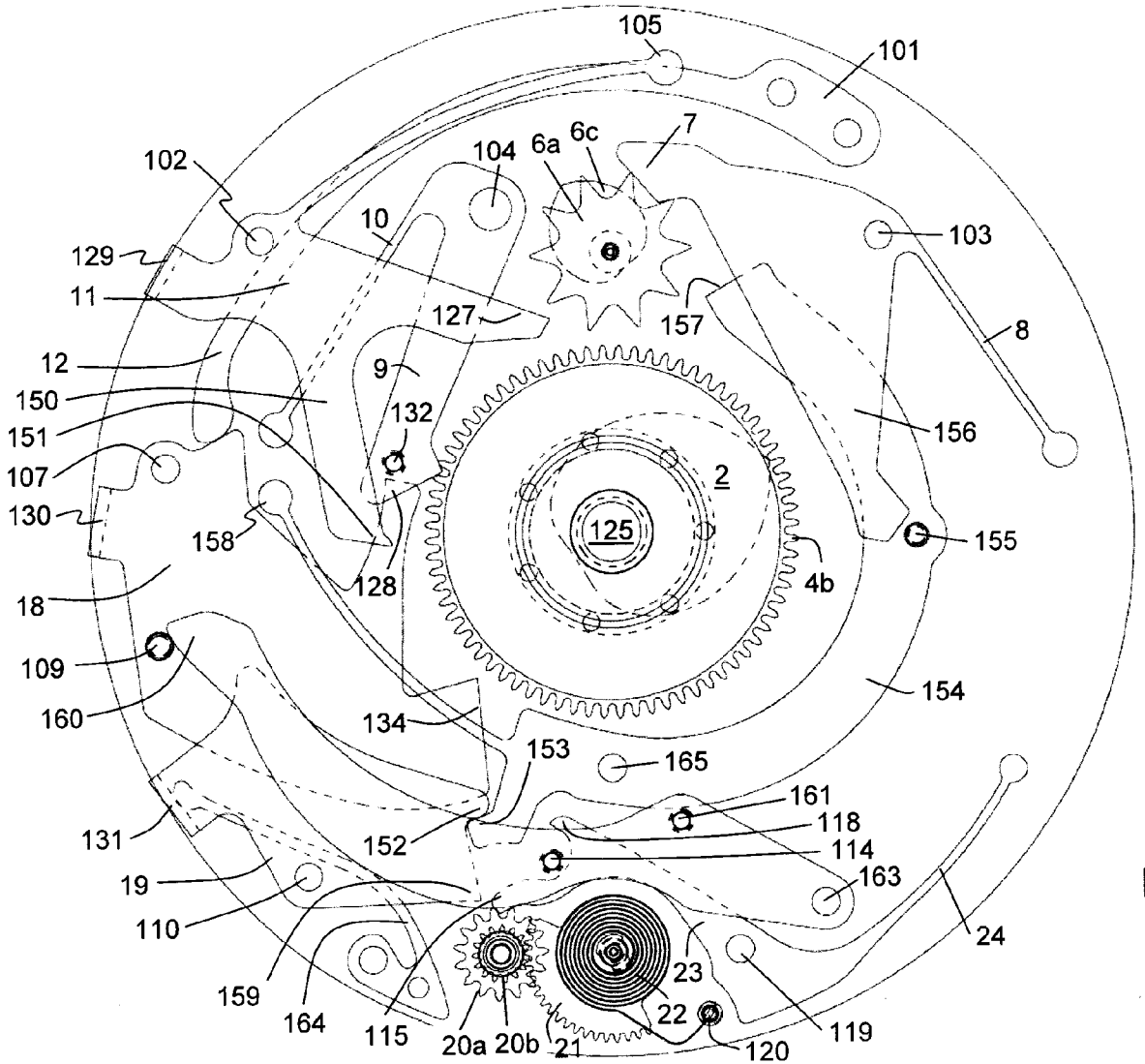
FIG. 5 the essential parts of a second preferred embodiment of the golf counter.
Figure 6:
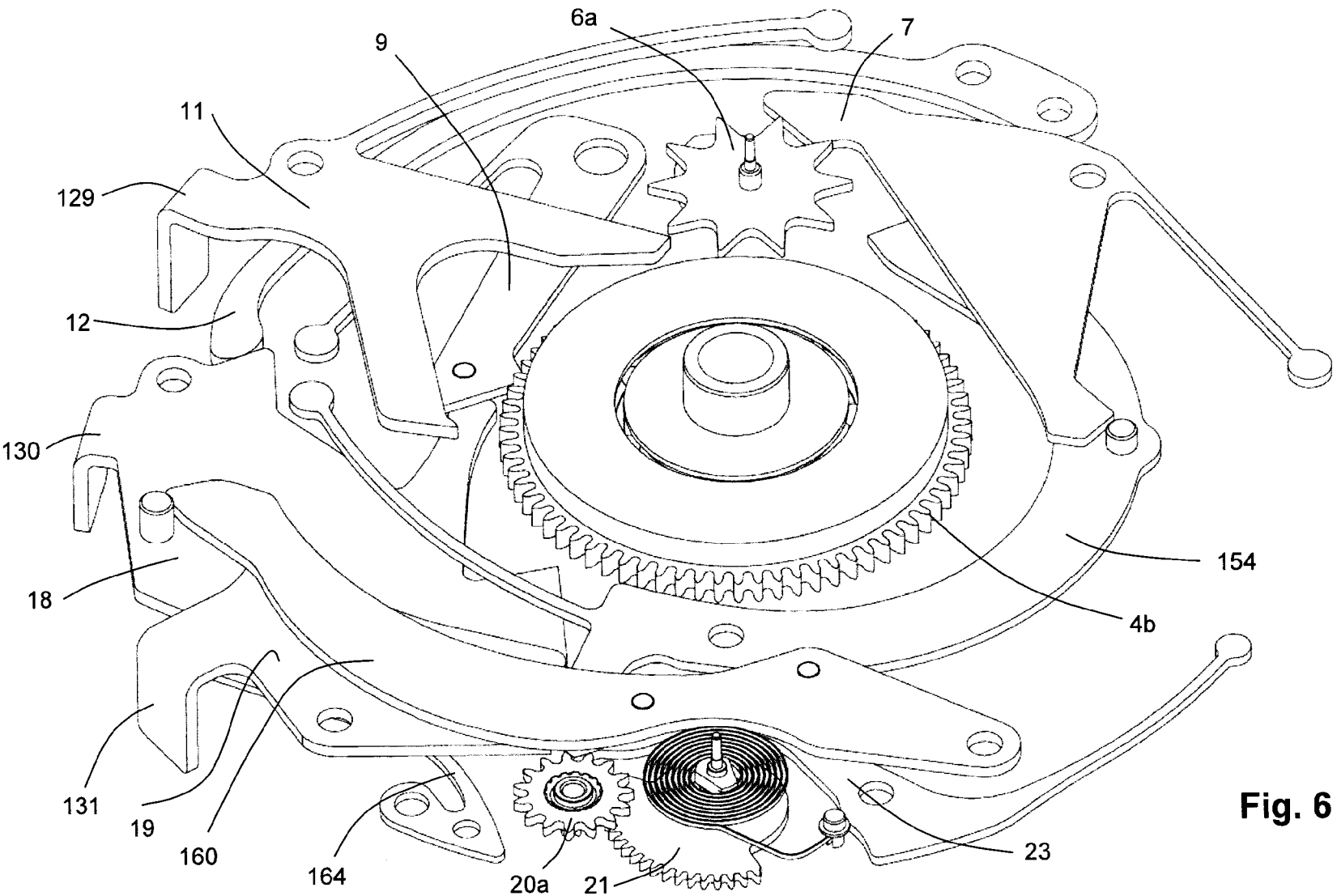
FIGS. 6 and 7 perspective views of the essential parts of this second embodiment.
Figure 7:
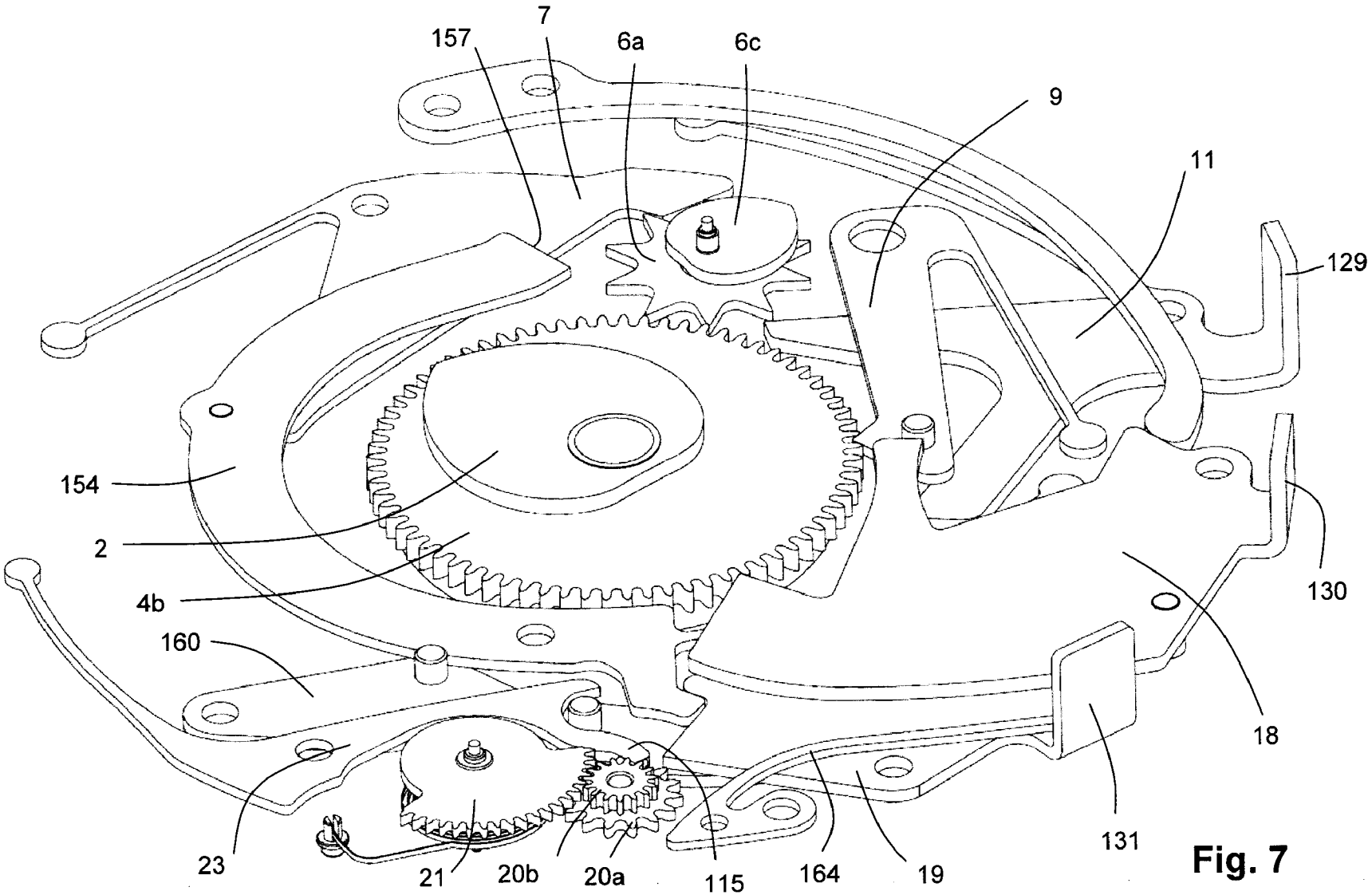

The stroke counter is actuated by way of pressing —via a first press button 210 —onto a press button arm 129 of a stroke counting rocker 11. This rocker rotates about a pivot 102. Thereby, a lever arm 127 of the stroke counting rocker 11 rotates a star 6*a* further by one position, in the clockwise direction in FIG. 5. The star 6*a* is subjected to the effect of a detent 7 which is rotatable about a pivot 103 and presses against a detent spring 8. In FIG. 5, the detent spring is integrally formed onto the detent 7 as one piece, but it may also be formed thereon separately as in FIG. 2. Fastened on the star 6*a* is the hand 202 for the display of the strokes per hole. On letting-go of the stroke counting rocker 11, this is moved back into the initial position by a spring region against a spring end 10. A heart or heart heart-like eccentric 6*c*, fastened on the star 6*a*, serves for zeroing the position of the star 6*a*.

The rocker 11 comprises a further lever arm 150 whose tip 151, on pressing the stroke counter, engages into a toothing of a sum wheel 4*b* and rotates this further by one count position. A blocking pawl 9 with a spring 10 and rotatable about a pivot 104 is in engagement with the teeth of the sum wheel 4*b*, and acts as a detent. The sum wheel 4*b* is fixedly connected to a heart-like eccentric 2 and to the central hand 203 for the display of the total stroke number, so that these are commonly rotatable about the central pivot 125 of the arrangement.

On pressing the first press button 210, the stroke counter 202 per hole and the hand 203 for the display of the total stroke number are both rotated further by one count position.

The hole counter is actuated by way of pressing —via a second press button 212 —onto a press button arm 131 of a hole counting rocker 19. The hole counting rocker 19 rotates about a pivot 110. A first lug 152 of the hole counting rocker 19 presses against a projection 153 of a stroke counter zeroing lever 154. The stroke counter zeroing lever 154 rotates about a pivot 165, and by way of a pin 155 presses against a lever 156 of the detent 7 of the stroke counter. The detent 7 releases the cog 6*a* of the hole counter by way of this, and subsequently, due to the effect of an edge 157 of the stroke counter zeroing lever 154 on the heart 6*c* of the stroke counter, the stroke counter is rotated back into the zero position.

On actuating the hole counting rocker 19, a second lug 159 of the hole counting rocker 19 engages into a toothing of a star 20*a* of the hole counter, and rotates this further by one step, in FIG. 5 in the clockwise direction. The star 20*a* is subjected to the effect of a lug 115 of a detent 23, as well as of a detent spring 24. A cog 20*b* fastened on the star 20*a* is in engagement with a hole counting wheel 21, and rotates this further by one count position. The hand 204 for the display of the hole is fastened on the hole counting wheel 21. The hole counting wheel 21 is connected to a spring 22 with a fastening point 120 of the spring. The spring 22 is tensioned on counting up the hole number.

Thus, after the completed actuation of the hole counting rocker 19, the hand 202 for the number of strokes per hole is again at zero. The hole counter has been moved further by one position. The sum wheel 4*b* has not been influenced. On letting go of the hole counting rocker 19, the hole counter zeroing lever 154 is moved by way of a preferably integrally formed spring region against a spring end 158, back into the initial position. The hole counting rocker 19 by way of a spring 164 is moved back into its initial position.

For setting the whole device to zero, a press button arm 130 of a first zeroing lever 18 is actuated via a third press button 211. This zeroing lever rotates about a pivot 107. A lug 128 on the first zeroing lever 18 thereupon, via a pin 132, lifts the blocking pawl 9 from the sum wheel 4*b*, and subsequently an edge 134 of the first zeroing lever 18 moves the heart-like eccentric 2 back into the zero position. The sum wheel 4*b* and the central hand 203 also get into the zero position with this. The lug 128 is formed such that the pin 132 is not moved away without effort, but that a force threshold must firstly be overcome, before the pin 132 with the blocking pawl 9 snaps away, and the zeroing lever 18 for zeroing all counting mechanisms is moved further.

The other counters are also zeroed simultaneously with the outlined zeroing of the sum hand 203. A pin 109 of the first zeroing lever 18 catches a further zeroing lever 160, which rotates about a pivot 163. The further zeroing lever 160 in turn, by way of the first pin 161, moves the already known stroke counter zeroing lever 154 of the stroke counter which sets the stroke counter to zero as already described above.

The further zeroing lever 160 furthermore via a second pin 114, moves a lug 118 of the detent 23 of a hole counter against the force of the detent spring 24. By way of this, at the lug 115, the star 20*a* of the hole counter is released, and the star 20*a* and the hole counting wheel 21 are rotated back into the zero position by the spring 22.

On letting go of the press button of the first zeroing lever 18, this is rotated back into the initial position by way of a restoring spring 12 which is fastened on a fastening point 101.

So that the mechanism has space in a housing which is as flat as possible, the mentioned parts of the mechanism are arranged around the sum wheel 4*b* with the heart 2 (when looking onto the sum wheel 4*b* in the perpendicular direction). Only on zeroing the sum wheel 4*b* does one of these parts (the edge 134 of the zeroing lever 18) engage into the region of the sum wheel 4*b*. In particular, the stroke counter zeroing lever 154 reaches around the sum wheel 4*b* with the heart 2, having a sickle-like shape, and specifically roughly around half the clockwork. By way of this, it reaches from a region of the third counting mechanism (at the projection 153 of the stroke counter zeroing lever 154) up to a region of the first counting mechanism (at the edge 157 of the stroke counter zeroing lever 154).

The device may yet comprise further elements, for example, locking means for preventing a simultaneous actuation of several press buttons.

Proceeding from the principles described here and from essentially equally structured mechanics, one may also realize other arrangements. For example, the hand 202 for the display of the strokes per hole may be arranged concentrically to the sum hand 203 and be coupled to the cog 6*b* via a further cog or a toothed belt. Furthermore, the number of the counter positions per revolution may be varied without further ado at each of the counters. The third counting mechanism, instead of the spring 22, may also comprise a heart or a section of a heart for zeroing by way of a corresponding section of one of the zeroing levers 17, 18 or of a further lever connected thereto. The first counting mechanism for the number of strokes per hole instead of the detent 7, may also comprise a restoring mechanism with a spring, as with the hole counter.

The invention claimed is:

1. A purely mechanical golf counter for use in a watch, comprising:

a first mechanical counting mechanism with a display (202) for counting a number of strokes per hole, a second mechanical counting mechanism with a display (203) of a total number of strokes, and a third mechanical counting mechanism with a display (204) of played holes, wherein a press button (212) for indexing the third counting mechanism to the next position automatically sets the first counting mechanisms back into a zero position, wherein the display of the second counting mechanism is a single sum hand (203) rotatable about a central pivot (125) of the golf counter (203), wherein a rotation pivot (125) of the sum hand (203) is arranged coaxially to rotation pivots of at least an hour hand (207) and a minute hand (208) of a clockwork, and wherein a bezel (205) is rotatably arranged about a dial (201) of the golf counter, and the bezel (205) comprises markings (206) for setting a handicap with respect to a sum scale (207) of the sum hand (203).

2. A purely mechanical golf counter for use in a watch, comprising;

a first mechanical counting mechanism with a display (202) for counting a number of strokes per hole, a second mechanical counting mechanism with a display (203) of a total number of strokes, and a third mechanical counting mechanism with a display (204) of played holes, wherein a press button (212) for indexing the third counting mechanism to the next position automatically sets the first counting mechanisms back into a zero position, wherein the display of the second counting mechanism is a single sum hand (203) rotatable about a central pivot (125) of the golf counter (203), and wherein the fulcrums of all three counting mechanisms are arranged along a straight line, the line dividing the watch in which the counter is used into two portions, and press buttons (210, 211, 212) for operating the counter are all arranged on the same portion of the watch.

3. A purely mechanical golf counter for use in a watch, comprising:

a first mechanical counting mechanism with a display (202) for counting a number of strokes per hole, a second mechanical counting mechanism with a display (203) of a total number of strokes, a third mechanical counting mechanism with a display (204) of played holes, wherein a press button (212) for indexing the third counting mechanism to the next position automatically sets the first counting mechanisms back into a zero position, and an advance mechanism, which on actuation of a single press button (212), moves the third counting mechanism further by one position, couples the first counting mechanism to the second counting mechanism, moves the first counting mechanism back into the zero position and thereby, by way of this coupling, reads out a number of the strokes from the first counting mechanism and adds them in the second counting mechanism, wherein the display of the second counting mechanism is a single sum hand (203) rotatable about a central pivot (125) of the golf counter (203).

4. A purely mechanical golf counter for use in a watch, comprising:

a first mechanical counting mechanism with a display (202) for counting a number of strokes per hole, a second mechanical counting mechanism with a display (203) of a total number of strokes, a third mechanical counting mechanism with a display (204) of played holes, wherein a press button (212) for indexing the third counting mechanism to the next position automatically sets the first counting mechanisms back into a zero position. and an advance mechanism, which on actuation of a single press button (212), moves the third counting mechanism further by one position, couples the first counting mechanism to the second counting mechanism, moves the first counting mechanism back into the zero position and thereby, by way of this counting, reads out a number of strokes from the first counting mechanism and adds them in the second counting mechanism, wherein the display of the second counting mechanism is a single sum hand (203) rotatable about a central pivot (125) of the golf counter (203), wherein the first counting mechanism comprises a sum transmission wheel (4*a*) with a toothing, the position of the sum transmission wheel (4*a*) corresponding to the number of counted strokes per hole, the second counting mechanism comprises a sum wheel (4*b*) with a toothing, the position of the sum wheel (4*b*) corresponding to the total number of strokes, and wherein on coupling the first counting mechanism with the second counting mechanism, a transmission cog (16) is in engagement with the sum transmission wheel (4*a*) as well as with the sum wheel (4*b*), and wherein the sum transmission wheel (4*a*) and the sum wheel (4*b*) are arranged concentrically over one another and have the same toothing, and wherein for the coupling, the transition cog is arranged on a transmission lever (15) in a manner pivotable against the sum transmission wheel (4*a*) and the sum wheel (4*b*).

5. A purely mechanical golf counter for use in a watch, comprising:

a first mechanical counting mechanism with a display (202) for counting a number of strokes per hole, a second mechanical counting mechanism with a display (203) of a total number of strokes, and a third mechanical counting mechanism with a display (204) of played holes, wherein a press button (212) for indexing the third counting mechanism to the next position automatically sets the first counting mechanisms back into a zero position, wherein the display of the second counting mechanism is a single sum hand (203) rotatable about a central pivot (125) of the golf counter (203), wherein a rotation pivot (125) of the sum hand (203) is arranged coaxially to rotation pivots of at least an hour hand (207) and a minute hand (208) of a clockwork, and wherein a bezel (205) is rotatably arranged about a dial (201) of the golf counter, and the bezel (205) comprises markings (206) for setting and indicating a handicap with respect to a sum scale (207) of the sum hand (203), the sum scale (207) being arranged at the edge of the dial (201) for reading off the position of the sum hand (203), and the handicap being set by rotating the bezel (205) until a particular bezel marking (206) is located opposite a stroke number on the sum scale (207), which stroke number corresponds to the handicap.

* * * * *

UNITED STATES PATENT AND TRADEMARK OFFICE

CERTIFICATE OF CORRECTION

PATENT NO. : 7,457,201 B2
APPLICATION NO. : 11/609649
DATED : November 25, 2008
INVENTOR(S) : Jaermann et al.

It is certified that error appears in the above-identified patent and that said Letters Patent is hereby corrected as shown below:

Column 10, Line 15 (Claim 4, Line 17), delete “counting”, and insert --coupling--.

Signed and Sealed this

Fourteenth Day of April, 2009

John Doll

JOHN DOLL
*Acting Director of the United States Patent and Trademark Office*